US007514879B2

(12) United States Patent
Crandall et al.

(10) Patent No.: US 7,514,879 B2
(45) Date of Patent: Apr. 7, 2009

(54) METHOD AND SYSTEM FOR DRIVING A PLASMA-BASED LIGHT SOURCE

(75) Inventors: Earl F. Crandall, Raleigh, NC (US); Robert C. Smallwood, Englewood, CO (US); Ray King, Carolina Beach, NC (US)

(73) Assignee: PureSpectrum, Inc., Savannah, GA (US)

( * ) Notice: Subject to any disclaimer, the term of this patent is extended or adjusted under 35 U.S.C. 154(b) by 413 days.

(21) Appl. No.: 10/995,470

(22) Filed: Nov. 24, 2004

(65) Prior Publication Data

US 2005/0134198 A1 Jun. 23, 2005

Related U.S. Application Data

(60) Provisional application No. 60/524,760, filed on Nov. 25, 2003.

(51) Int. Cl.
*G05F 1/00* (2006.01)
*H05B 41/16* (2006.01)
*H05B 39/00* (2006.01)

(52) U.S. Cl. ..... 315/291; 315/247; 315/224

(58) Field of Classification Search ..... 315/291, 315/307, 302, 246, 224, 267, 268, 272, 264, 315/247, 254, 274, 209 R
See application file for complete search history.

(56) References Cited

U.S. PATENT DOCUMENTS

| | | | | |
|---|---|---|---|---|
| 4,240,009 | A * | 12/1980 | Paul | 315/224 |
| 5,634,711 | A * | 6/1997 | Kennedy et al. | 362/119 |
| 5,698,952 | A * | 12/1997 | Stebbins | 315/307 |
| 6,144,175 | A * | 11/2000 | Parra | 315/307 |
| 6,400,511 | B2 * | 6/2002 | Vanlier et al. | 359/634 |
| 6,441,564 | B1 * | 8/2002 | Gu et al. | 315/291 |
| 2004/0000880 | A1 * | 1/2004 | Ozasa et al. | 315/291 |
| 2006/0126021 | A1 * | 6/2006 | Vanlier et al. | 353/31 |

* cited by examiner

*Primary Examiner*—Douglas W. Owens
*Assistant Examiner*—Minh Dieu A
(74) *Attorney, Agent, or Firm*—Alston & Bird LLP

(57) ABSTRACT

A gas discharge lamp is driven with a constant current square wave from a current transformer where the number of volt-microseconds are designed such that at the start of each square wave, the voltage rises to the required ionization potential for the lamp, while the plasma has not yet started to conduct. As soon as the lamp ionizes the gas within the lamp and current flows, the voltage drops and current flows at the desired level. The current level is set to prevent the input of excessive power pulses into the lamp, to reduce the creation of infrared photons. In addition, the plasma is driven at this current level almost continuously (with reversing polarity), which does not allow the plasma time to cool down. Consequently, the lamp becomes a more efficient light emitter, thereby requiring less energy to achieve the same light output.

16 Claims, 4 Drawing Sheets

METHOD AND SYSTEM FOR DRIVING A PLASMA-BASED LIGHT SOURCE

Priority is claimed from U.S. Provisional Application No. 60/524,760, filed Nov. 25, 2003.

BACKGROUND OF THE INVENTION

Conventional electronic and magnetic ballasts typically use resonant or quasi-resonant circuits to impress an AC current through plasma in a lighting tube of a plasma-based light source. FIG. 1 is a schematic representation of plasma 10 in a tube having one electrode 12 at each end. The plasma is situated between the electrodes and moves back and forth, making contact with one end and then the other. Where contact is made, there is contact resistance Rc. The non-contacted end incurs a small gap in the plasma, which produces a capacitance Cs, through which power must flow. The plasma itself has an ionization potential Vz, a series resistance Rs, a series inductance Lp, and an inertial resistance Ri of the plasma to movement. Additionally, there are thermal effects which need not be considered for purposes of the present disclosure.

An electronic equivalent circuit model of the plasma and tube is shown in FIG. 2. In addition to the parameters discussed above, the equivalent model includes a representation of two other phenomena. A parallel capacitance Cp exists between the lamp terminals T1 and T2 when the lamp is not conducting. This capacitance is a very small value in most tubes. A leakage resistance Rlk can be present on the external surface of the lamp. This resistance may only play a role in areas of very high humidity and dust, dirt or other contaminants. This simplified model of a plasma tube does not consider filaments that may be used in some tubes.

Conventional 60 Hz magnetic ballasts include simple transformers with very high impedance secondary windings to provide an output current that is self-limiting. They also include windings for each of the lamp filaments. At startup the filaments get most of the power, heating up to start ionization.

The secondary voltage builds up to a very high value, and the lamp becomes fully ionized as the gas becomes plasma between the two filaments. The effective resistance of the conducting plasma is quite low and the current flow is limited by the secondary windings' impedance. The transformer core partially saturates, which reduces the power available to the filaments.

The majority of the losses in this circuit come from several areas, which include; core saturation, copper losses in the transformer secondary, and losses in the plasma. The voltage waveform across the electrodes is shown in FIG. 3. The sine wave voltage reaches ionization potential $V_z$ and continues to rise. The current is then limited by the resistance in the ballast secondary windings and is dissipated by the copper losses in the windings. The ionized gas, i.e., plasma, emits photons having wavelengths that are dependent on the chemical makeup of the gas(es) and by the temperature of the plasma that is formed by the ionization of the gas. Excessive current in the plasma causes the plasma temperature to rise until infrared photons are emitted from the plasma. The infrared photons, however, are an inefficient use of energy in lighting applications, since they do not contribute to the visible light output. Instead, the infrared photons give off heat, which cools the plasma. As a result, more energy must be added to the plasma to replace the lost heat, which adds to the inefficiency.

The 'black body' radiation (absolute temperature in degrees Kelvin) of the plasma determines the light output. At low plasma temperatures, mostly infrared photons will be generated. At higher plasma temperatures more visible and ultraviolet light than infrared light will be generated. In fluorescent lamps, ultraviolet light is converted to visible light by the phosphor coatings. The spectral radiant emittance is determined by the formula used to determine the black body radiation spectrum:

$$U_\lambda := \frac{8\cdot\pi\cdot(k\cdot T)^5}{(h\cdot c)^4}\cdot\frac{\left(\frac{h\cdot c}{\lambda\cdot k\cdot T}\right)^5}{e^{\left(\frac{h\cdot c}{\lambda\cdot k\cdot T}\right)}-1}$$

Where:

$U_\lambda$ is Spectral Radiant Emittance in W $cm^{-2}$ $\mu^{-1}$ $\lambda$ is an integer energy level T is absolute temperature $h=6.626*10^{-34}$ (Planck's constant)

$c=2.998*10^{8}$ (speed of light in a vacuum)

$k=1.381*10^{-23}$ (Boltzsman's constant)

As shown in FIG. 4, the shaded area represents excess power of every cycle that must be dissipated in the ballast and lamp(s). This wasted power causes excessive heat in the ballast and lamp(s); which shortens the lifetime of both the ballast and lamp(s).

FIG. 5 illustrates the conduction time for the plasma current, which pulsates due to the off times $T_{off}$ between the sine wave peaks $T_{on}$. This result occurs because the voltage V across the lamp drops below the ionization voltage between pulses $T_{on}$, and little or no current I flows during the off time $T_{off}$. The plasma begins to cool down during $T_{off}$ because little or no current I is flowing. The plasma must then be re-heated at the start of the next current pulse. This continual reheating adds to the losses and the heat in the lamp and ballast.

DETAILED DESCRIPTION

Figure 1:
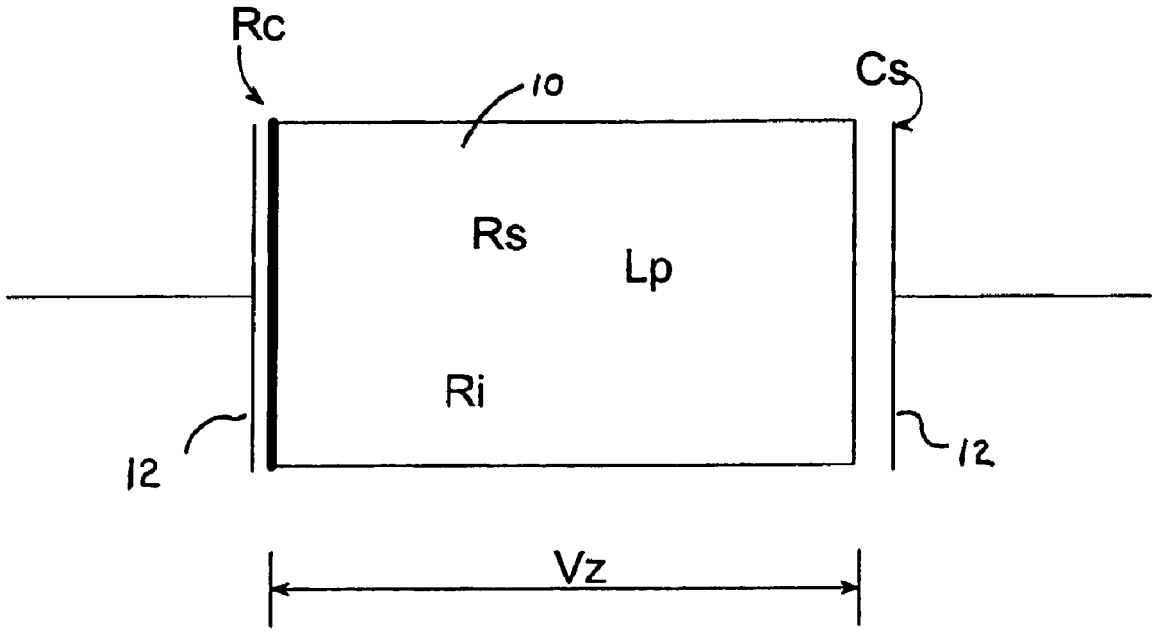
Fig. 1 PRIOR ART
FIG. 1 is a schematic representation of plasma in a gas discharge tube.
Figure 2:
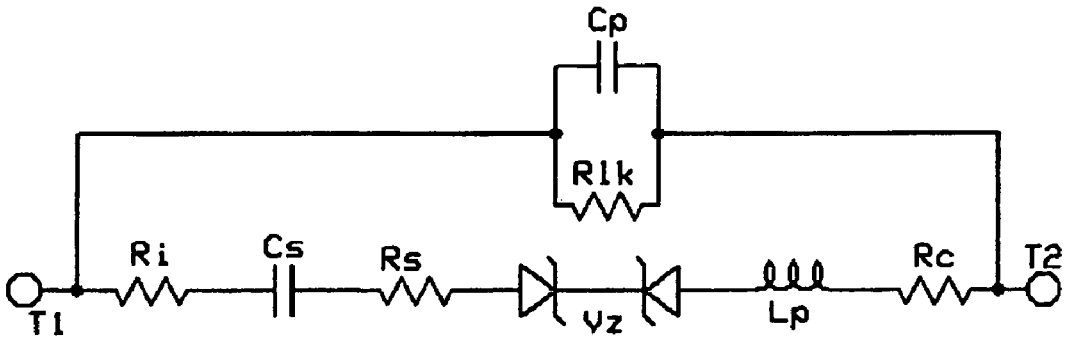
Fig. 2 PRIOR ART
FIG. 2 is an equivalent electrical circuit model of the plasma in the tube.
Figure 3:
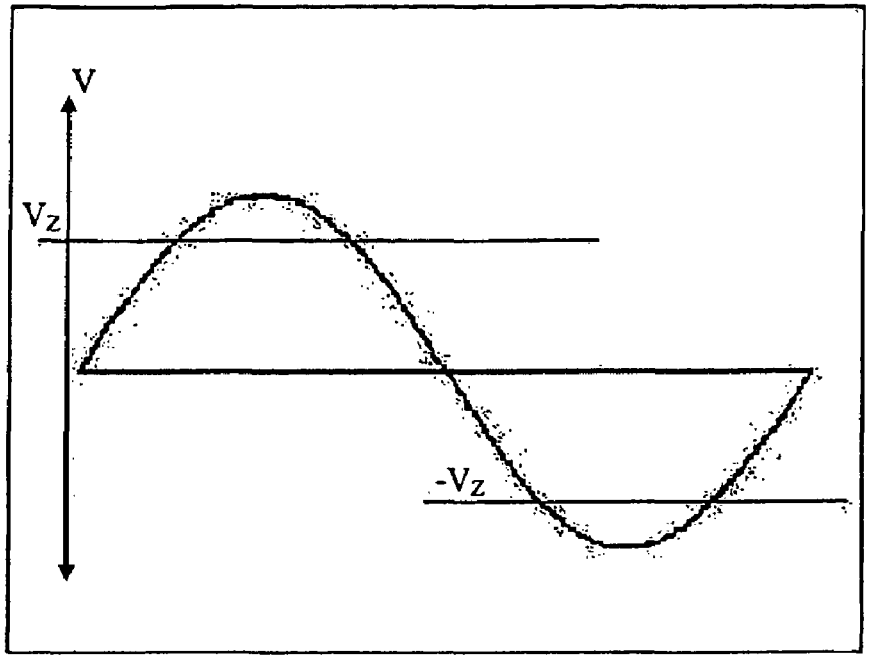
Fig. 3 PRIOR ART
FIG. 3 is a graph of the ionization potential in the tube.
Figure 4:
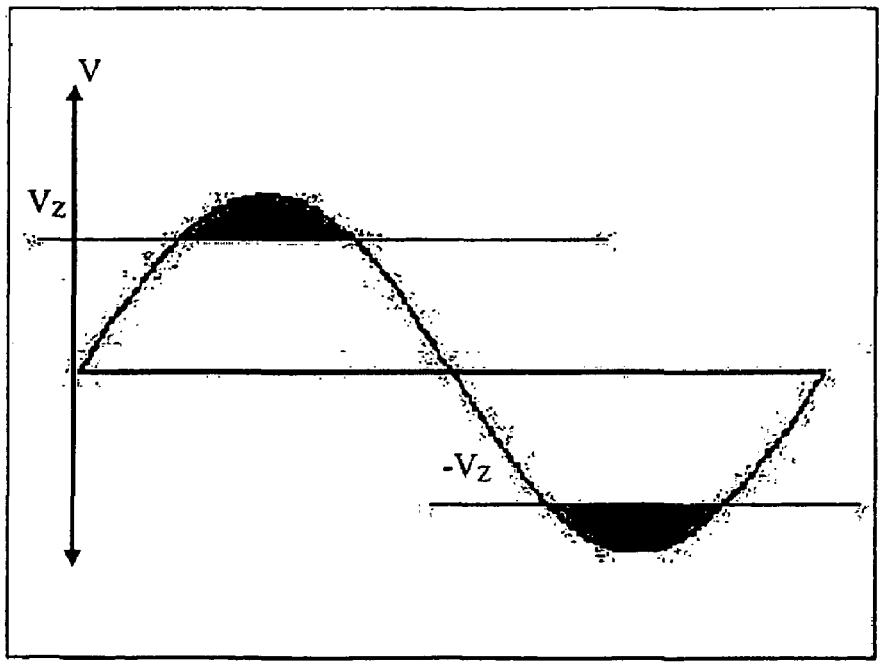
FIG. 4 is a graph similar to FIG. 3, illustrating the losses that occur during the operation of the gas discharge tube.
Figure 5:
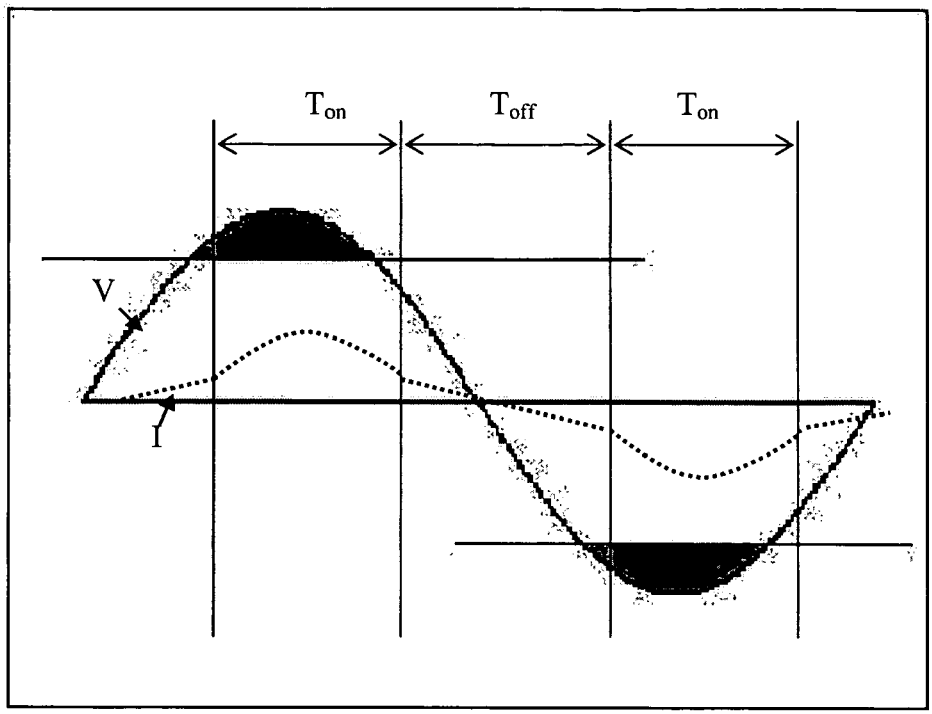
FIG. 5 is a graph similar to FIG. 4, illustrating the heat losses that occur as a result of plasma cooling, and the plasma current waveform.
Figure 6:
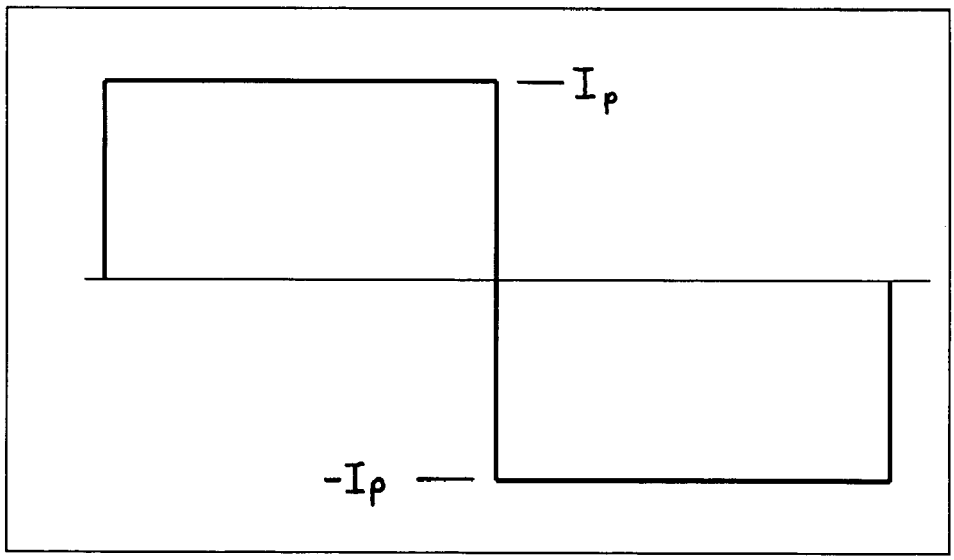
FIG. 6 is a graph of a square wave driving current signal.

The preferred solution to the foregoing situation, in accordance with the present invention, is to apply a square-wave driven at a constant current to the plasma tube, such as a gas discharge lamp, as shown in FIG. 6. This approach provides several desirable effects, including the elimination of resonances within the bulb. This technique is applicable to both a direct application of a current within a tube or to inducing fields for applying the energy to plasma within the tube. It creates Photopic and Scotopic light more efficiently than the previously-described approach.

The disclosed method for driving the lamp is adaptable to drive any plasma-based light source. It will be primarily described herein with reference to driving a gas discharge lamp by way of example. The temperature level of the plasma determines the light output spectrum. At low plasma temperatures, mostly infrared photons are generated. The disclosed technique avoids inputting any extra energy, other than what is required for the creation of photons of the desired wavelength. It is preferable to produce light with a color temperature above 3000K, up to 6500K. To keep the plasma temperature as high as required, power is limited to about 30% of the lamp wattage rating. The lamp still produces the full light output as specified in watts per square meter at a given distance as compared to conventional ballasts. At higher plasma temperatures, visible and ultraviolet light will be generated, preferably around 6500K color temperature. In fluorescent lamps, ultraviolet light is converted to visible light by the phosphor coating inside the lamp. The spectral radiant emittance is determined by Planck's Radiation Law.

Excessive energy that is put into the lamp becomes heat causing the emission of photons in the infrared region that come out of the lamp as heat. This results in wasted energy, as far as creating light is concerned, and it lowers the temperature of the plasma.

The lamp is driven with a constant current square wave (or near perfect square wave) as shown in FIG. 6. The current level $I_p$ is set to prevent the input of excessive power into the lamp, to reduce the creation of infrared photons. In addition, the plasma is driven at this current level $I_p$ almost continuously (with reversing polarity), which does not allow the plasma time to cool down. Consequently, the lamp becomes a more efficient light emitter, thereby requiring less energy to achieve the same light output.

Figure 7:
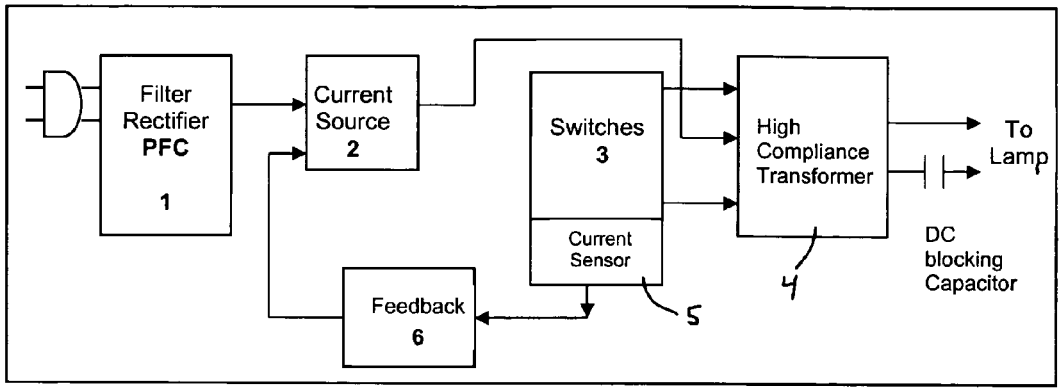
FIG. 7 is a block diagram of a circuit for producing the square wave signal.

An exemplary circuit that can be used to create the desired waveform is shown in FIG. 7. An AC or DC input power is connected to an input conditioning circuit 1. The DC output from this circuit is connected to a current source 2. Another input to the current source is a current sense feedback 6, which comes from a current sensor 5. The output from the current source 2 is fed to a high-compliance coupling transformer 4.

The input conditioning circuit 1 includes input conditioning for the AC or DC power source. This may include, but is not limited to, transient protection, noise filtering, fusing, rectification, EMI/RFI filtering, and power factor correction. The power factor correction circuitry, when employed, may be either a buck or a boost type design. It may be passive or active; or of any type that performs the desired task.

One implementation of the current source 2 can be a pulse width modulated synchronous buck converter. Other methods of creating a current source will be familiar to those skilled in the art. The current source can have its output fed through a choke to limit the rate of change of current. This circuit also contains a timer. The timer is designed such that it shuts off the current to the tube in case the tube is broken or removed or fails to start for some reason. The duty cycle is not critical but a good practical solution is to use a duty cycle that allows the tube to try to restart once every 1-100 seconds, and although it could be even longer or shorter. This circuitry tests for the presence of a load in the transformer circuit via the feedback. If no load is detected the timer stops the power generation for a period of time before testing again. The buck inductor may also contain a winding for housekeeping power.

A switching circuit 3 includes push-pull drivers and switches which can be operating synchronously with the buck converter in the current source, but are not required to do so. Many types of semiconductors could be employed in this circuit. These switches can be operated at an independent frequency from the buck, but RFI concerns can be more easily addressed when using a single frequency or synchronized multiple frequency approach. This circuit may also contain clamping circuitry. A plurality of drivers and switches may be employed for operation of multiple phase lamps.

The high compliance coupling transformer 4 includes a current transformer, which may have 400 to 650 volts or more on the primary winding for start up. This energy produces a narrow pulse of voltage that is coupled to the secondary winding before the core saturates. The secondary winding produces the required high voltage pulses to start the tube. When the tube ionizes, the voltage drops to a level which does not saturate the transformer. The normal operation is a square wave at a low peak-to-peak voltage. As those skilled in this art will know, this low voltage can be selected to be anywhere in the low voltage range but practical limits suggest that the low voltage should be in the range of 12 to 50 volts. This voltage will be chosen depending upon the startup voltage that the lamp requires for reliable starting.

The transformer produces a clean duty cycle of approximately 50% current on each half of the primary winding and coupling to the tube from the secondary winding of the transformer, thus producing a constant AC current in the tube. This waveform is preferably as close to a perfect square wave as practical. In other words, the push-pull drivers in the switching circuit are respectively activated and deactivated simultaneously, in an alternating manner, so that the current switches between +Ip and −Ip as close to instantaneously as possible, rather than gradually transitioning between these two levels as in a sine wave. Leakage inductance from the transformer supports the load current during primary switch crossover, that is, when both switches in the switching circuit are simultaneously open or closed, thus opening or shorting, respectively the primary winding of the high coupling transformer.

Current sensor 5 provides current amplitude information back to the current source, to maintain a constant current. As those of skill in this art will appreciate, there are many methods of sensing current that can be employed in various parts of the circuit for this task.

The feedback circuit 6 provides the current sense information back to the regulated current source to maintain a constant current, and therefore a constant power, in the lamp. Additionally, this circuit may contain a light sensor (not shown) to assist in keeping the light level uniform during the warm-up of the lamp and plasma and throughout the life of the lamp. This feature gives the lamp a more constant output level so that all lamps in an area will seem more uniform.

As shown in FIG. 7, the lamp can include an optional DC blocking capacitor in series with the lamp load. While this is generally only required in fluorescent lamps, good engineering practice suggests that it should always be included in any design to provide maximum lamp life.

The efficiency of this design is achieved by producing a near perfect current driven square-waveform to the lamp. This results in a lamp current that is constant at the correct value to produce the desired light output without excessive heating. While this concept will operate at nearly any frequency, currently available components perform well around 50 KHz. The transformer 4 is a current transformer where the correct number of volt-microseconds are designed such that at the start of each square wave, the voltage will rise to the required ionization potential for the lamp under no-load conditions, when the plasma has not yet started to conduct. As soon as the lamp ionizes the gas within the lamp and current flows, the voltage drops as the current flows at the desired level.

At startup, the energy accumulated in the transformer is used in a very brief instant to create a voltage spike for lamp ignition until the lamp heats up. Once ignition occurs, the energy in the transformer is used to create photons at maximum efficiency. Designing the current transformer for both the right running current capacity and the right volt-microsecond product for ignition can be accomplished by those familiar with the art.

The problems of oscillation that plague some conventional ballast designs do not occur with the disclosed technique because the current is constant. When the voltage is steady, oscillation occurs due to lamp current instabilities and resonances. When powered by a simple square wave from a constant current source through a current transformer, these instabilities disappear.

The constant current drive can also be applied to light emitting diodes (LEDs) for lighting with improved efficiency.

Testing of a sampling of lamps has demonstrated the improved efficiency obtained. Some of these test results as compared to conventional ballasts are tabulated below.

| Technology | Bulb Type | Rated Watts For Bulb | Conventional Ballast Power Required | Improved Ballast Power Required | % Power Reduction |
|---|---|---|---|---|---|
| Metal Halide | Street Lights | 55 W | 55 W | 16.5 W | 70% |
| | | 70 W | 70 W | 21 W | 70% |
| HID | CDM 35/PAR30/M/FL | 39 W | 40 W | 12 W | 70% |
| Fluorescent | 4' Linear Tube | 40 W | 32-40 W | 12 W | 70% |

Although other lamp technologies, such as High Pressure Sodium, Low Pressure Sodium, Neon, Xenon, Krypton and Argon, have not been tested, it is believed that similar results can be expected.

The method and system described herein offer several advantages, some of which are listed below:

- very high efficiency electronic ballast for gas discharge lamps that can reduce power consumption by as much as 70%;
- producing very white light in the Photopic and Scotopic regions;
- excitation of plasma at maximum efficiency for desirable photon production;
- excitation of plasma at maximum efficiency for less heat production;
- self-starting for all gas discharge lamps;
- stable operation of lamps without parasitic oscillations;
- quiet operation without hum or buzz in the lamp or ballast.;
- greater efficiency with up to 70% power reduction of input power with the same light output level from the lamp as compared to standard magnetic ballasts;
- works with fluorescent, HID, metal halide, and high pressure and low pressure sodium lamps, as well as for any gas discharge light;
- the gas discharge lamp operation can be mathematically modeled;
- can be used as constant current drive for LED lamps used for lighting and illumination
- elimination of wasted power resulting in heat reduces building heat loads;
- cooler lamps have longer life, reducing the maintenance costs.

It will be appreciated by those of ordinary skill in the art that the invention can be embodied in various specific forms without departing from its essential characteristics. The disclosed embodiments are considered in all respects to be illustrative and not restrictive. The scope of the invention is indicated by the appended claims, rather than the foregoing description, and all changes that come within the meaning and range of equivalents thereof are intended to be embraced thereby.

What is claimed is:

1. A method of driving a plasma-based light source with an electronic ballast, comprising the steps of:

applying a constant current square wave to plasma in the light source; and maintaining a current level of the constant current square wave to obtain a temperature of the plasma that maximizes the release of light in the visible and UV light spectrums.

2. The method according to claim 1, wherein the maintaining step further comprises providing current feedback information from a switching circuit to said current source to maintain a constant current level.

3. The method according to claim 1, wherein the applying step further comprises providing sufficient ignition voltage to ionize the plasma in the plasma-based light source.

4. The method according to claim 3, wherein when the tube ionizes, the voltage drops to maintain the constant current level.

5. An electronic ballast system for driving a plasma-based light source, comprising:

a switching circuit that applies a constant current square wave to plasma in the light source; and a current source that maintains the current level of the constant current square wave at a level to obtain a temperature of the plasma that maximizes the release of light in the visible and UV light spectrums.

6. The system according to claim 5, wherein said switching circuit comprises a push-pull circuit.

7. The system according to claim 6, wherein said switching circuit further comprises clamping circuitry.

8. The system according to claim 5, wherein said current source includes a pulse-width modulated synchronous buck converter.

9. The system according to claim 8, wherein output of said current source is fed through a choke to limit the rate of change for the current.

10. The system according to claim 8, wherein said current source further comprises a timer that shuts off current to a tube in case the tube is broken, removed, or fails to start.

11. The system according to claim 5, further including a current sensor for providing current feedback information from said switching circuit to said current source to maintain a constant current level.

12. The system according to claim 11, wherein in said current sensor further comprises a light sensor to assist in keeping the light level uniform during warm-up of the lamp and plasma and throughout the life of the lamp.

13. The system according to claim 5, further comprising a transformer for providing sufficient ignition voltage to ionize the plasma in the plasma-based light source.

14. The system according to claim 13, wherein when the tube ionizes, the voltage drops to a level which does not saturate said transformer.

15. The system of claim 5, further comprising an input conditioning circuit for conditioning the input of the AC or DC power source, wherein the input conditioning comprises at least one of transient protection, noise filtering, fusing, rectification, EMI/RFI filtering, and power factor correction.

16. An electronic ballast system for driving a plasma-based light source, comprising:

means for applying a constant current square wave to plasma in the plasma-based light source;

means for providing the sufficient ignition voltage to ionize the plasma in the plasma-based light source; and means for maintaining a current level of the constant current square wave to obtain a temperature of the plasma that maximizes the release of light in the visible and UV light spectrums.

* * * * *